US007815495B2

(12) United States Patent
Xu et al.

(10) Patent No.: US 7,815,495 B2
(45) Date of Patent: Oct. 19, 2010

(54) PAD CONDITIONER

(75) Inventors: Kun Xu, Fremont, CA (US); Jimin Zhang, San Jose, CA (US); James C. Wang, Saratoga, CA (US); Thomas H. Osterheld, Mountain View, CA (US); Yutao Ma, Fremont, CA (US); Steven M. Zuniga, Soquel, CA (US); Jin Yi, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 424 days.

(21) Appl. No.: 11/734,063

(22) Filed: Apr. 11, 2007

(65) Prior Publication Data

US 2008/0254722 A1 Oct. 16, 2008

(51) Int. Cl.
*B24B 53/12* (2006.01)

(52) U.S. Cl. ..... 451/443; 451/444

(58) Field of Classification Search ..... 451/56, 451/444, 443

See application file for complete search history.

(56) References Cited

U.S. PATENT DOCUMENTS

| | | | | |
|---|---|---|---|---|
| 3,743,489 | A | 7/1973 | Wentorf, Jr. et al. | |
| 3,767,371 | A | 10/1973 | Wentorf, Jr. et al. | |
| 4,062,660 | A | 12/1977 | Nicholas et al. | |
| 4,225,322 | A | 9/1980 | Knemeyer | |
| 4,661,180 | A | 4/1987 | Frushour | |
| 4,845,902 | A * | 7/1989 | Bolliand | 451/527 |
| 5,643,052 | A | 7/1997 | Delattre et al. | |
| 6,159,087 | A | 12/2000 | Birang et al. | |
| 6,200,199 | B1 | 3/2001 | Gurusamy et al. | |
| 6,224,470 | B1 * | 5/2001 | Hoey et al. | 451/285 |
| 6,300,223 | B1 | 10/2001 | Chang et al. | |
| 6,322,427 | B1 | 11/2001 | Li et al. | |
| 6,325,709 | B1 | 12/2001 | Nanda et al. | |
| 6,341,997 | B1 | 1/2002 | Lin | |
| 6,361,423 | B2 | 3/2002 | Gurusamy et al. | |
| 6,371,836 | B1 * | 4/2002 | Brown et al. | 451/56 |
| 6,386,963 | B1 * | 5/2002 | Kenji et al. | 451/443 |
| 6,476,488 | B1 | 11/2002 | Jeng et al. | |
| 6,524,357 | B2 | 2/2003 | Baldoni et al. | |
| 6,540,597 | B1 | 4/2003 | Ohmori et al. | |
| 6,551,176 | B1 | 4/2003 | Garretson | |
| 6,632,127 | B1 | 10/2003 | Zimmer et al. | |
| 6,945,857 | B1 | 9/2005 | Doan et al. | |
| 7,033,253 | B2 * | 4/2006 | Dunn | 451/56 |
| 7,150,677 | B2 | 12/2006 | Yamashita et al. | |
| 2002/0065029 | A1 * | 5/2002 | Huang et al. | 451/72 |
| 2002/0127962 | A1 | 9/2002 | Cho et al. | |
| 2006/0035568 | A1 * | 2/2006 | Dunn | 451/56 |
| 2009/0075567 | A1 * | 3/2009 | Wang et al. | 451/56 |

* cited by examiner

*Primary Examiner*—Maurina Rachuba
(74) *Attorney, Agent, or Firm*—Patterson & Sheridan, LLP

(57) ABSTRACT

A pad conditioner is provided for conditioning a polishing pad in chemical mechanical planarization (CMP). The pad conditioner comprises a plastic abrasive portion having a first hardness and optionally a brush portion having a second hardness less than the first hardness. The plastic abrasive portion comprises a base plate and a plurality of plastic nodules formed on a surface of the base plate, each of the plastic nodules having a planar top surface, wherein the planar top surface is positioned to substantially contact a polishing pad. The brush portion may be positioned adjacent to the plastic abrasive portion, the brush portion having a plurality of brush elements positioned to substantially contact the pad.

4 Claims, 6 Drawing Sheets

PAD CONDITIONER

BACKGROUND OF THE INVENTION

1. Field of the Invention

The present invention relates to a pad conditioner, and more particularly to a pad conditioner used for conditioning a polishing pad in chemical mechanical planarization (CMP).

2. Description of the Related Art

In the fabrication of integrated circuits (ICs) and display elements, CMP is used to planarize the surface topography of a substrate for subsequent deposition processes. During CMP, the surface of the substrate to be planarized is brought into contact with the surface of a polishing pad, and the substrate and the polishing pad are rotated and translated relative to each other with a polishing slurry supplied to polish a substrate. After the CMP process is performed for a certain period of time, the polishing surface of the polishing pad becomes glazed due to accumulation of slurry by-products and/or material removed from the substrate and/or the polishing pad. Glazing reduces pad asperity, provides less localized pressure, thus reducing the polishing rate. In addition, glazing may cause the polishing pad to lose some of its capacity to hold the slurry, further reducing the polishing rate.

Typically, the properties of the glazed polishing pad can be restored by a process of conditioning with a pad conditioner. The pad conditioner is used to remove the unwanted accumulations on the polishing pad and regenerate the surface of the polishing pad to a desirable asperity. Typical pad conditioners include an abrasive head generally embedded with diamond abrasives which can be rubbed against the pad surface of the glazed polishing pad to retexture the pad. The abrasive head embedded with diamond abrasives has the advantage of maintaining the removal rate for the polishing pad. However the diamond abrasives may be too aggressive for conditioning the polishing pad and thus shorten the pad life, especially for a soft polishing pad. Hence, it is desirable to have a pad conditioner with proper abrasives for alleviating aggression on the polishing pad, especially on the soft polishing pad. Furthermore, diamond alone can not remove accumulations inside pad grooving, which is usually much deeper than the height of the diamond abrasive.

In addition to the abrasive head of the pad conditioner, a brush can be used to brush off the loosened material and clean up slurry byproduct residues. The brush may be used on a separate conditioning head or attached to the conditioning head in place of the abrasive head during conditioning operations. Although the brush has the advantage of removing slurry by-products, it cannot regenerate pad surface asperity to retain the removal rate throughout the pad life. Hence, it is desirable to have a pad conditioner on which the abrasive head is combined with the brush for simultaneously addressing both removal rate and defect issues, and also saving operation time.

SUMMARY OF THE INVENTION

According to one aspect of the invention, a pad conditioner comprises a plastic abrasive portion having a first hardness. The plastic abrasive portion comprises a base plate and a plurality of plastic nodules, wherein the plastic nodules are formed on a surface of the base plate, each of the plastic nodules having a planar top surface positioned to substantially contact a polishing pad. The materials forming the base plate and/or the plastic nodules may include PPS (Polyphenylene Sulfide), PET (polyethylene terephthalate), polyimide, polyamide-imide or others. XL-20 is one example of a polyamide-imide.

In another aspect, the pad conditioner further comprises a brush portion disposed adjacent to the plastic abrasive portion. The brush portion has a plurality of brush elements positioned to substantially contact the polishing pad, and has a second hardness that is less than the first hardness of the plastic abrasive portion. The material forming the brush elements may include PET or nylon, and the height of each of the brush elements may be greater than the height of each of the plastic nodules.

In another aspect, the plastic abrasive portion and the brush portion are concentric.

In another aspect, the plastic abrasive portion encloses or surrounds the brush portion.

In another aspect, the brush portion is divided into a plurality of brush regions, and the brush regions are evenly distributed around a portion of the plastic abrasive portion.

In a further aspect, the pad conditioner comprises a first controller and a second controller. The first controller is used for controlling a first pressure applied to the plastic abrasive portion, and the second controller for controlling a second pressure applied to the brush portion.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention are generally directed to pad conditioners using plastic nodules in place of the diamond abrasives for conditioning a CMP polishing pad, especially for a soft polishing pad. One example of a soft pad is a pad having a Shore A hardness equal to or less than 70. The plastic nodules can be made of materials such as PPS, PET, polyimide or polyamide-imide. Since the hardness of the plastic nodules is less than that of the conventional diamond abrasives, but is still sufficient to perform the functions of retexturing the pad surface, the application of plastic nodules can avoid being too aggressive on the polishing pad, thus prolonging the pad life. A soft polishing pad is typically embossed to define polishing squares with grooving in between. For each of the polishing squares, it is composed of open pores with A NAP thickness of about a few hundred micrometers and an open pore height in the range of 10 μm-500 μm.

Some embodiments of the present invention are further directed to pad conditioners having a hybrid conditioning head combining a plastic abrasive portion with a brush portion, wherein plastic nodules and brush elements are respectively installed on the plastic abrasive portion and the brush portion, thereby improving pad conditioning. The plastic abrasive portion is used for maintaining the removal rate of the polishing pad, and the brush portion is used for removing slurry by-products accumulated in the pad groovings.

The plastic abrasive portion and the brush portion are adjacent to each other, and can be arranged in various patterns for satisfactorily conditioning different types of polishing pads. Hereinafter, several patterns are described as examples, but the invention is not limited thereto, and the area ratio of the plastic abrasive portion to the brush portion can be varied and is not limited to the embodiments shown in the figures.

EXAMPLE 1

Figure 1B:
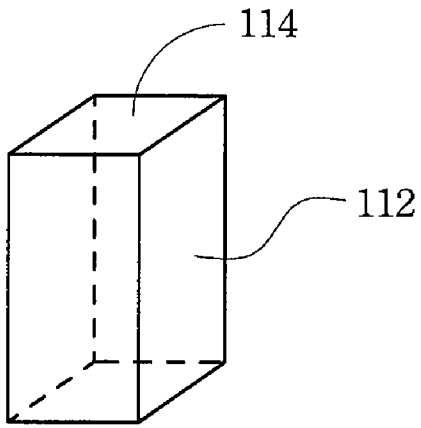
FIG. 1B is a schematic view showing an exemplary structure of a plastic nodule of one embodiment of the present invention.
Figure 1A:
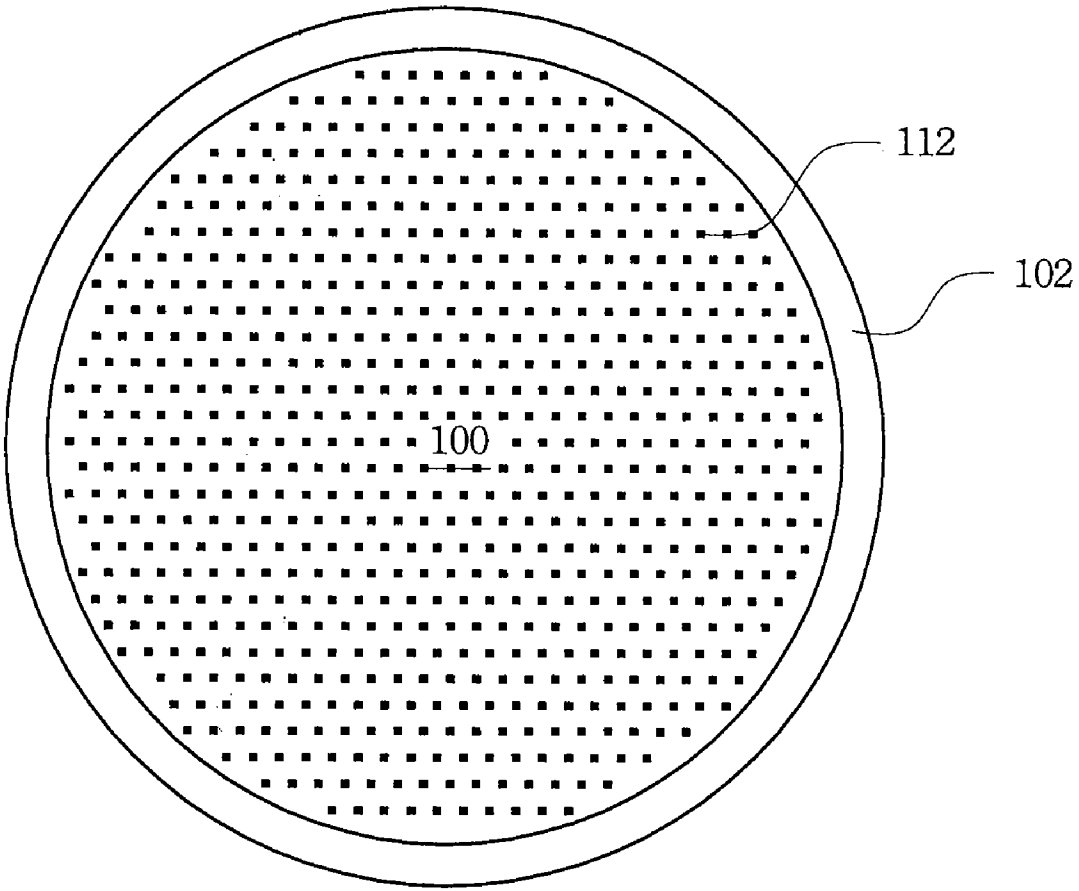
FIG. 1A is a schematic plan view showing a conditioning surface of a pad conditioner according to one aspect of the present invention.

FIG. 1A is a schematic plan view showing a conditioning surface 100 of a pad conditioner according to one embodiment of the invention. FIG. 1B is a schematic view showing an exemplary structure of a plastic nodule of the present invention. In this embodiment, the conditioner has a plastic abrasive portion (the conditioning surface 100) on which a plurality of plastic nodules 112 are uniformly distributed. The plastic nodules 112 are formed on a base plate 102. The base plate 102 may be made of materials such as PPS, PET polyimide or polyamide-imide, and the material forming the base plate 102 can be the same as or different from that forming the plastic nodules 112. The shape of each of the plastic nodules 112 can be, for example, a rectangular prism as shown in FIG. 1B. However, other types of prisms or the like are also applicable to the plastic nodules contemplated herein. For example, the plastic nodules may be rectangular, square, circular, oval, or kidney-shape, among others. The shape determines the peripheral length over area, which determines the aggressiveness of the conditioning function. Each of the plastic nodules 112 has a planar top surface 114 positioned to contact a polishing pad during conditioning operations. In comparison with the conventional diamond abrasives, the plastic nodules 112 have the advantages of low cost, easy fabrication and appropriate hardness.

EXAMPLE 2

Figure 2A:
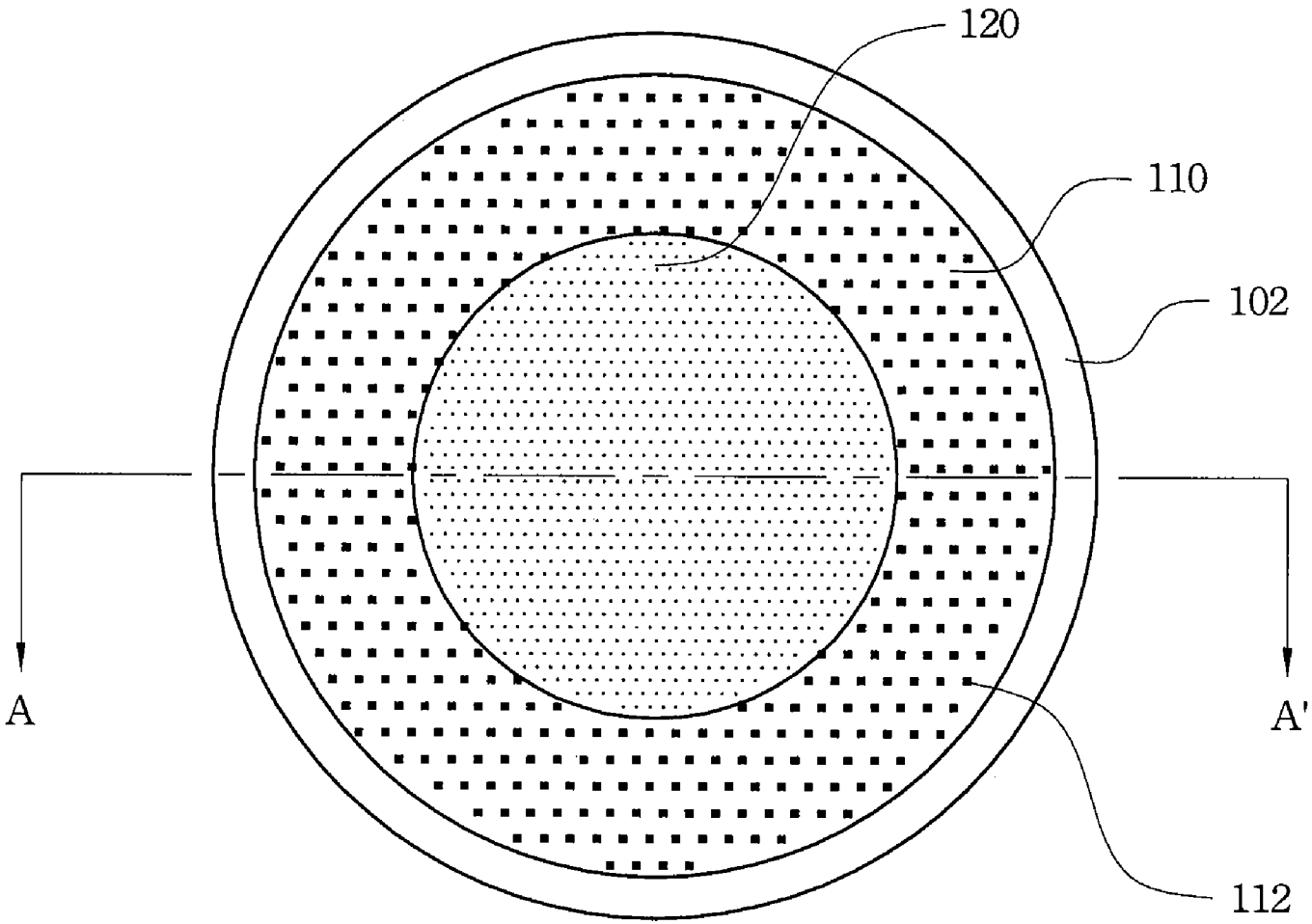
FIG. 2A is a schematic plan view showing a conditioning surface of a pad conditioner according to another aspect of the present invention.
Figure 2B:
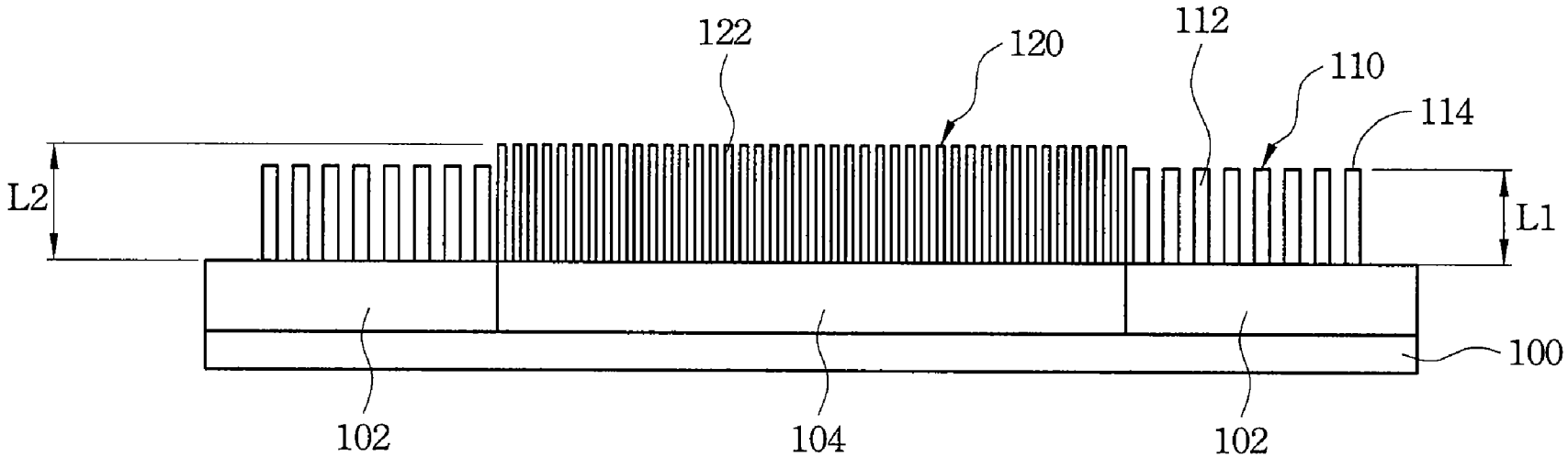
FIG. 2B is a schematic cross-sectional diagram viewed along line A-A' shown in FIG. 2A.

FIG. 2A is a schematic plan view showing a conditioning surface of a pad conditioner according to another embodiment of the invention. FIG. 2B is a schematic cross-sectional diagram viewed along line A-A' shown in FIG. 2A. In this embodiment, the pad conditioner has a plastic abrasive portion 110 having a first hardness and a brush portion 120 having a second hardness less than the first hardness, wherein the plastic abrasive portion 110 and the brush portion 120 are concentric. The brush portion 120 is adjacent to the plastic abrasive portion 110, and is enclosed by the annularly-shaped plastic abrasive portion 110. The plastic abrasive portion 110 comprises a base plate 102 and the plastic nodules 112 are formed on a surface of the base plate 102. As shown in FIG. 2B, the brush portion 120 comprises a plurality of brush elements 122 installed on a base plate 104, wherein the base plate 104 and the base plate 102 can be formed as one single plate or two different plates, and both are fixed on a metal disk 100. The brush elements 122 can be made of PET or nylon in the form of fibers or bristles, but are not limited to thereto, and may be varied in accordance with the requirement of the rigidity of the brush elements 122. For the soft PET fibers, an adhesive film (not shown) is used to adhere PET fibers to the inner circle of the metal disk 100 with or without the base plate 104. For the nylon brush elements in the form of bristles on top of the base plate 104 such as a polypropylene disk, the polypropylene disk can be mounted onto the inner circle of the metal disk 100 by using screws. The height L2 of the brush elements 122 is slightly greater than the height of the plastic nodules 112, so that the brush elements 122 are allowed to be bent to reach into the grooves of the polishing pad while the plastic nodules 112 still maintain good contact with the top surface of the polishing pad for conditioning the polishing pad. In some cases, the surface of the metal disk 100 in which the brush elements 120 are mounted can be machined back to allow the optimum relative height difference between the top surface of the brush portion 120 and the top surface of the plastic abrasive portion 110.

In this embodiment, the plastic abrasive portion 110 and the brush portion 120 are positioned adjacent to each other, and contact the polishing pad at the same time, so that the brush portion 120 can sweep material loosened by the plastic abrasive portion 110 from the polishing pad promptly, thereby preventing the loosened material from being re-embedded in the polishing pad or the plastic abrasive portion 110.

EXAMPLE 3

Figure 3:
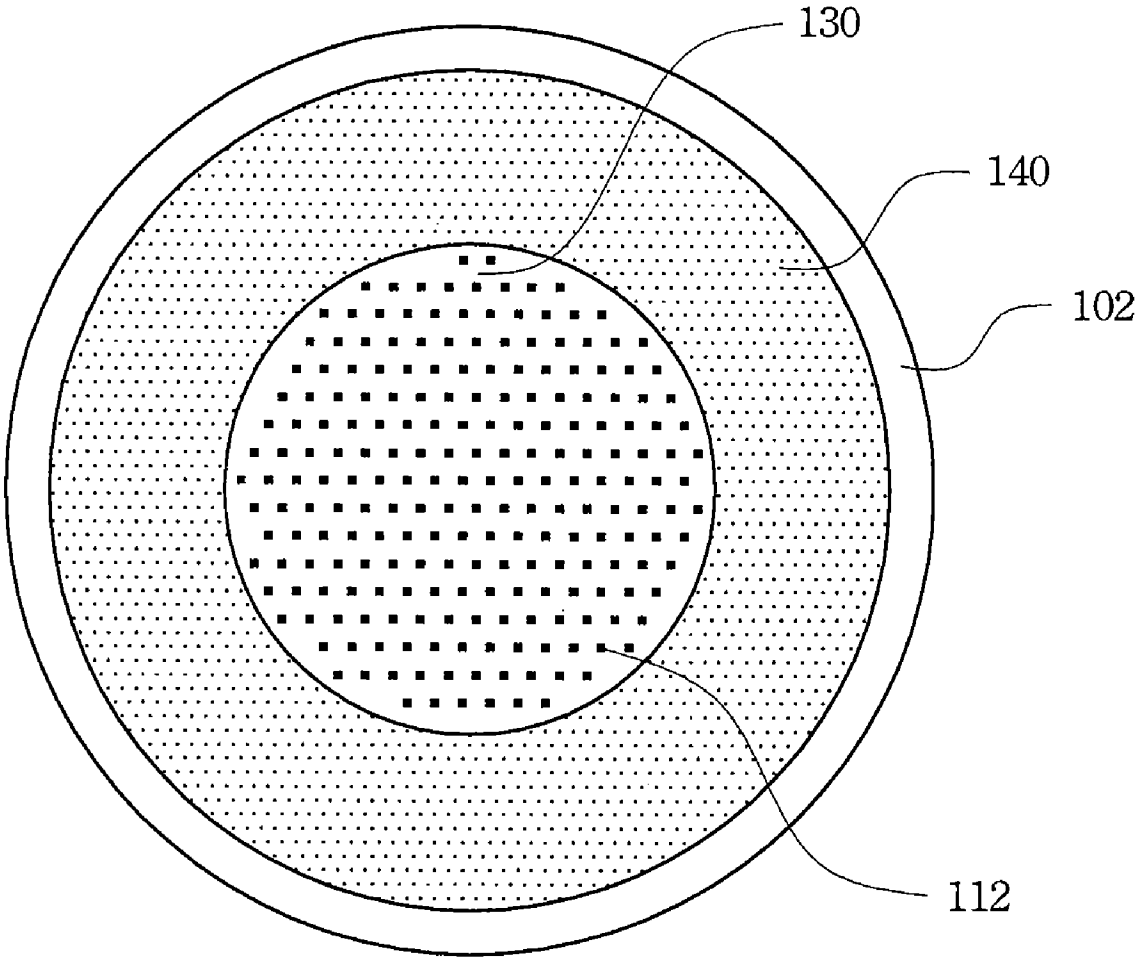
FIG. 3 is a schematic plan view showing a conditioning surface of a pad conditioner according to another aspect of the present invention.

FIG. 3 is a schematic plan view showing a conditioning surface of a pad conditioner according to yet another embodiment of the invention. In this embodiment, the pad conditioner has a plastic abrasive portion 130 having a first hardness and a brush portion 140 having a second hardness less than the first hardness, wherein the plastic abrasive portion 130 and the brush portion 140 are concentric. The plastic abrasive portion 130 is enclosed by the annularly-shaped brush portion 140. The plastic abrasive portion 130 comprises a base plate 102 and the plastic nodules 112 are formed on a surface of the base plate 102. Similarly, the plastic abrasive portion 130 and the brush portion 140 are positioned adjacent to each other, and contact the polishing pad at the same time, so that the brush portion 140 can sweep material loosened by the plastic abrasive portion 130 from the polishing pad promptly, thereby preventing the loosened material from being embedded again in the polishing pad or the plastic abrasive portion 130.

EXAMPLE 4

Figure 4:
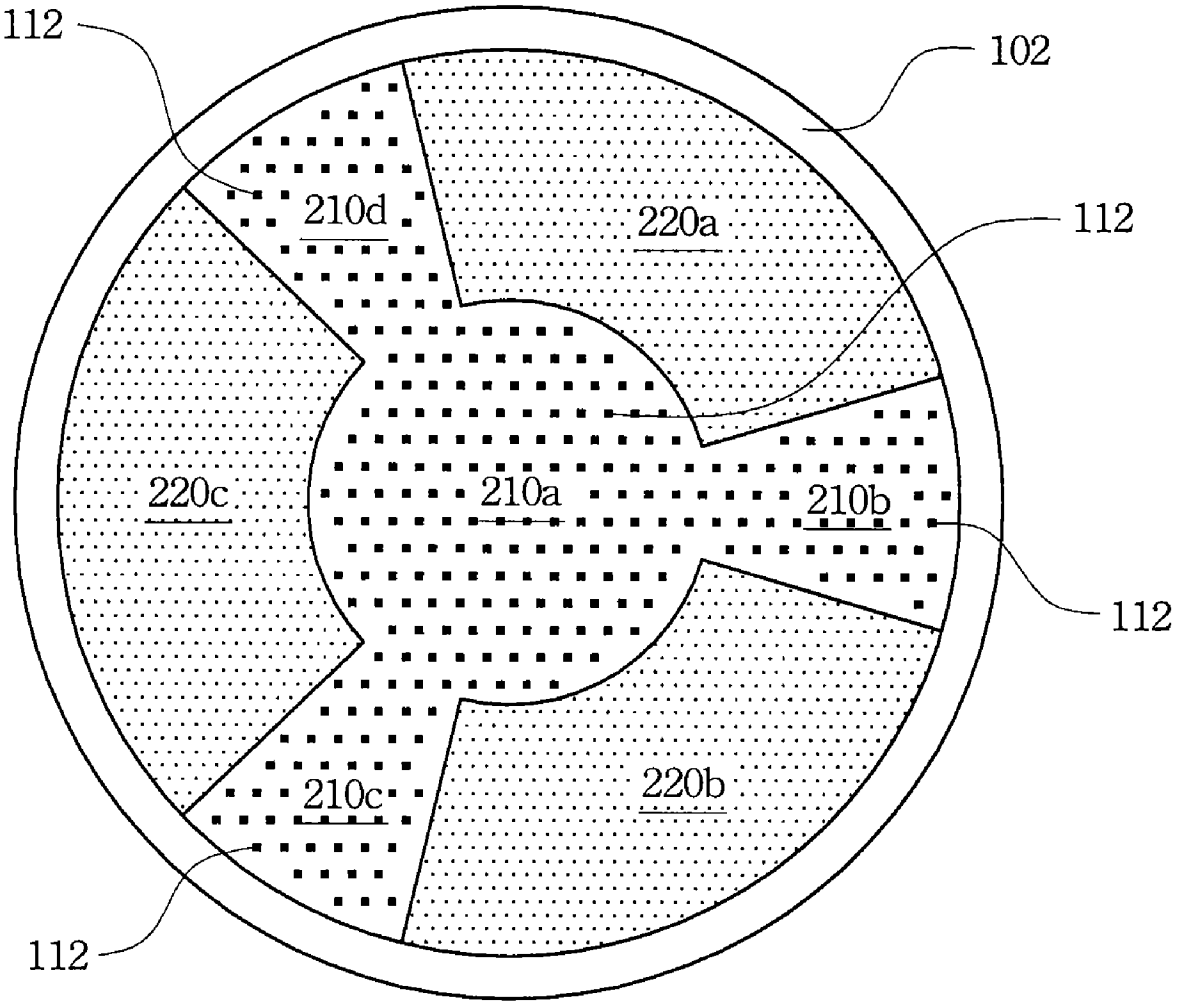
FIG. 4 is a schematic plan view showing a conditioning surface of a pad conditioner according to a further aspect of the present invention.

FIG. 4 is a schematic plan view showing a conditioning surface of a pad conditioner according to a further embodiment of the present invention. In this embodiment, the pad conditioner has a plastic abrasive portion (not labeled) composed of a central portion 210*a* and peripheral portions 210*b*, 210*c* and 210*d* having a first hardness; and a brush portion (not labeled) divided into a plurality of brush regions 220*a*, 220*b* and 220*c* having a second hardness less than the first hardness. The brush regions 220*a*, 220*b* and 220*c* are evenly distributed around the central portion 210*a* of the plastic abrasive portion, and the peripheral portions 210*b*, 210*c* and 210*d* of the plastic abrasive portion extending outwards from the central portion 210*a* are respectively filled in a gap between adjacent brush regions, i.e., the peripheral portion 210*b* is filled between the brush region 220*a* and the brush region 220*b*; the peripheral portion 210*c* is filled between the brush region 220*b* and the brush region 220*c*; and the peripheral portion 210*d* is filled between the brush region 220*c* and the brush region 220*a*. The plastic abrasive portion comprises a base plate 102 and the plastic nodules 112 are formed on a surface of the base plate 102. In this embodiment, the brush regions 220*a*, 220*b* and 220*c* are respectively arranged among the portions 210*a*, 210*b*, 210*c* and 210*d* of the plastic abrasive portion. For example, when the base plate 102 is rotated clockwise, the brush elements in the brush region 220*a* (220*b*; 220*c*) follow the motion of the peripheral portion 210*b* (210*c*; 210*d*) of the plastic abrasive portion to brush away loosened material before the peripheral portion 210*d* (210*b*; 210*c*) of the plastic abrasive portion re-embeds the loosened material. Accordingly, with this arrangement of the plastic abrasive portion and the brush portion, the loosened material is swept away relatively quickly, since the chance for loosened material meeting the brush portion increases.

Moreover, the conditioning head can be controlled by one or more controllers to provide pressure to the plastic abrasive portion and the brush portion. With one controller, the same pressure is applied to both the plastic abrasive portion and the brush portion of the conditioning head. Further, it may be desirable to provide at least two independent controllers for individually controlling the pressure applied to the plastic abrasive portion and the brush portion to provide the flexibility of adjusting the performance for the plastic abrasive portion and the brush portion if needed. Herein, the arrangement of the plastic abrasive portion and the brush portion shown in FIGS. 2A and 2B is used as an example for explanation, but other arrangements or patterns shown in the other figures are also applicable, and the invention is not limited thereto. Other arrangements and patterns (not shown) are also contemplated herein.

Figure 5:
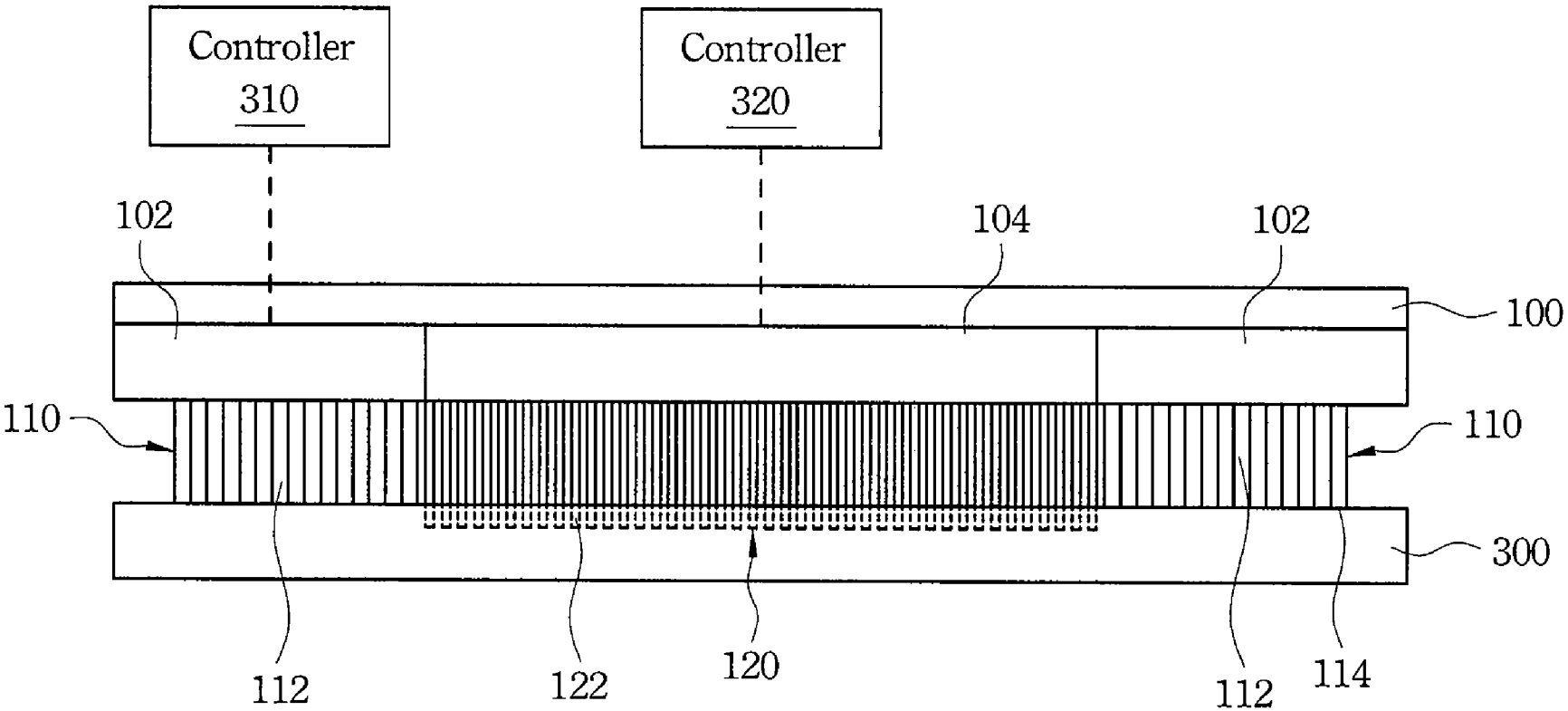
FIG. 5 is a schematic diagram showing a pad conditioner with independent controllers according to an aspect of the present invention.

FIG. 5 is a schematic diagram showing a pad conditioner with independent controllers according to another embodiment of the present invention. The plastic abrasive portion 110 and the brush portion 120 face downwards and contact a polishing pad 300 for performing conditioning operations, and are respectively controlled by a controller 310 and a controller 320. In general, the brush portion 120 requires less pressure than the plastic abrasive portion 110, since the brush portion 120 is used primarily for brushing off the loosened material, but the plastic abrasive portion 110 is responsible for removing the material trapped in the polishing pad 300 and retexturing the polishing pad 300. In this embodiment, two controllers 310 and 320 are used for controlling the pressure applied to two respective portions of the conditioning head. However, if necessary, more than two controllers can be adopted for controlling the pressures respectively applied to a plurality of regions of the brush portion and those of the plastic abrasive portion, such as shown in FIG. 4.

According to the forgoing embodiments, the present invention has the advantages of simultaneously addressing both removal rate and defect issues caused by slurry by-products or other residues, and also saving operation time; appropriate hardness for prolonging the pad life; and individually controlling the pressure applied to the brush portion and the plastic abrasive portion for increasing operation convenience.

While the foregoing is directed to embodiments of the present invention, other and further embodiments of the invention may be devised without departing from the basic scope thereof, and the scope thereof is determined by the claims that follow.

The invention claimed is:

1. A pad conditioner, comprising:

a plastic abrasive portion having a first hardness, wherein the plastic abrasive portion comprises:

a first base plate; and a plurality of plastic nodules formed on a surface of the first base plate, each of the plastic nodules having a planar top surface, wherein the planar top surface is positioned to substantially contact a polishing pad;

a brush portion adjacent to the plastic abrasive portion, the brush portion having a plurality of brush elements positioned to substantially contact the polishing pad, wherein the brush portion has a second hardness, and the second hardness is less than the first hardness and wherein a height of the plurality of brush elements is greater than a height of the plurality of plastic nodules; and a second base plate, wherein the plurality of brush elements are installed on the second base plate and the first base plate and the second base plate are fixed on a metal disk.

2. The pad conditioner of claim 1, wherein a surface of the metal disk on which the plurality of brush elements are mounted is machined back to allow the optimum relative height difference between a top surfaced of the plurality of brush elements and a top surface of the plurality of plastic nodules.

3. A CMP pad conditioner comprising:

a first base plate; and a plastic abrasive portion having a first hardness, wherein the plastic abrasive portion comprises:

a plurality of solid plastic nodules formed on a surface of the first base plate, each of the plastic nodules having a planar top surface, wherein the planar top surface is positioned to substantially contact a soft polishing pad;

a brush portion adjacent to the plastic abrasive portion, the brush portion having a plurality of brush elements positioned to substantially contact the pad, wherein the brush portion has a second hardness, and the second hardness is less than the first hardness and wherein a height of the plurality of brush elements is greater than a height of the plurality of solid plastic nodules; and a second base plate, wherein the plurality of brush elements are installed on the second base plate and the first base plate and the second base plate are fixed on a metal disk.

4. The pad conditioner of claim 3, wherein a surface of the metal disk on which the plurality of brush elements are mounted is machined back to allow the optimum relative height difference between a top surface of the plurality of brush elements and a top surface of the plurality of plastic nodules.

* * * * *